US008652738B2

(12) United States Patent
Yamaguchi et al.

(10) Patent No.: US 8,652,738 B2
(45) **Date of Patent: *Feb. 18, 2014**

(54) CONTACT DEVELOPING METHOD, IMAGE FORMING APPARATUS, AND PROCESS CARTRIDGE

(75) Inventors: Kimitoshi Yamaguchi, Shizuoka (JP); Shigenori Yaguchi, Shizuoka (JP); Hitoshi Iwatsuki, Shizuoka (JP); Mariko Takii, Shizuoka (JP); Toyoshi Sawada, Kanagawa (JP); Toyoaki Tano, Shizuoka (JP); Hiroshi Tohmatsu, Shizuoka (JP); Koichi Sakata, Shizuoka (JP); Hiroyuki Kishida, Shizuoka (JP); Saori Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

This patent is subject to a terminal disclaimer.

(21) Appl. No.: 13/181,702

(22) Filed: Jul. 13, 2011

(65) Prior Publication Data

US 2012/0058423 A1 Mar. 8, 2012

(30) Foreign Application Priority Data

Sep. 7, 2010 (JP) ..... 2010-200386

(51) Int. Cl.
*G03G 13/08* (2006.01)
*G03G 9/00* (2006.01)

(52) U.S. Cl.
USPC ..... 430/123.58; 430/111.3; 430/111.35

(58) Field of Classification Search
USPC ..... 430/111.1, 111.3, 111.31, 111.35, 430/123.4, 123.58
See application file for complete search history.

(56) References Cited

U.S. PATENT DOCUMENTS

| | | | |
|---|---|---|---|
| 7,381,513 | B2 | 6/2008 | Suzuki et al. |
| 7,527,908 | B2 | 5/2009 | Iwatsuki et al. |
| 7,553,598 | B2 | 6/2009 | Suzuki et al. |

(Continued)

FOREIGN PATENT DOCUMENTS

| | | |
|---|---|---|
| JP | 55-127569 | 10/1980 |
| JP | 55-157751 | 12/1980 |

(Continued)

OTHER PUBLICATIONS

U.S. Appl. No. 12/978,920, filed Dec. 27, 2010, Koichi Sakata, et al.

(Continued)

*Primary Examiner* — Stewart Fraser
(74) *Attorney, Agent, or Firm* — Oblon, Spivak, McClelland, Maier & Neustadt, L.L.P.

(57) ABSTRACT

A contact developing method including supplying a two-component developer to an electrostatic latent image on a rotating image bearing member by rotating a developing sleeve and a rotatable magnet having multiple magnetic poles provided inside the developing sleeve, to develop the electrostatic latent image into a toner image. The developing sleeve and the image bearing member rotate in the same direction while facing each other. The two-component developer comprises a non-magnetic toner and a carrier. The carrier comprises a magnetic core particle and a resin layer covering the magnetic core particle. The resin layer comprises a conductive particle and a resin. The conductive particle comprises an alumina-based material and a conductive layer covering the alumina-based material. The resin is obtained by heating a copolymer comprising a monomer A unit and a monomer B unit.

10 Claims, 4 Drawing Sheets

(56) References Cited

U.S. PATENT DOCUMENTS

| | | | | |
|---|---|---|---|---|
| 7,592,116 | B2 | 9/2009 | Suzuki et al. | |
| 8,211,610 | B2 * | 7/2012 | Yamaguchi et al. | 430/111.35 |
| 2006/0210905 | A1 | 9/2006 | Imahashi et al. | |
| 2007/0048652 | A1 | 3/2007 | Imahashi et al. | |
| 2008/0063969 | A1 * | 3/2008 | Yamaguchi et al. | 430/110.2 |
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0065037 | A1 | 3/2011 | Iwatsuki et al. | |
| 2011/0086307 | A1 * | 4/2011 | Nakajima et al. | 430/111.3 |
| 2011/0091802 | A1 * | 4/2011 | Takahashi et al. | 430/108.3 |
| 2011/0229817 | A1 * | 9/2011 | Yamada et al. | 430/111.35 |

FOREIGN PATENT DOCUMENTS

| | | |
|---|---|---|
| JP | 56-140358 | 11/1981 |
| JP | 57-96355 | 6/1982 |
| JP | 57-96356 | 6/1982 |
| JP | 58-207054 | 12/1983 |
| JP | 7-21654 | 3/1995 |
| JP | 7-120085 | 12/1995 |
| JP | 2959927 | 7/1999 |
| JP | 2959928 | 7/1999 |
| JP | 11-217389 | 8/1999 |
| JP | 3691115 | 6/2005 |

OTHER PUBLICATIONS

U.S. Appl. No. 13/037,569, filed Mar. 1, 2011, Saori Yamada, et al.

* cited by examiner

CONTACT DEVELOPING METHOD, IMAGE FORMING APPARATUS, AND PROCESS CARTRIDGE

CROSS-REFERENCE TO RELATED APPLICATIONS

The present patent application claims priority pursuant to 35 U.S.C. §119 from Japanese Patent Application No. 2010-200386, filed on Sep. 7, 2010, which is hereby incorporated by reference herein in its entirety.

BACKGROUND

1. Field of the Invention

The present invention relates to a method of developing electrostatic latent image with a two-component developer comprising a non-magnetic toner and a magnetic carrier. In addition, the present invention also relates to an image forming apparatus and a process cartridge including the two-component developer.

2. Description of the Background

In electrophotographic image formation, an electrostatic latent image is formed on an image bearing member comprising a photoconductive material, and the electrostatic latent image is developed into a toner image with a charged toner. The toner image is then transferred onto and fixed on a recording medium. Electrophotographic developing methods are of two types: one-component developing methods and two-component developing methods. One-component developing methods use a one-component developer consisting essentially of a toner. Two-component developing methods use a two-component developer comprising a toner and a magnetic carrier which may have a resin covering layer.

Toner particles are more reliably charged in two-component developing methods than in one-component developing methods because carrier particles provide a greater area for frictionally charging toner particles. Therefore, two-component developing methods are advantageous in producing high quality images for an extended period of time. Additionally, two-component developing methods have higher toner supplying power ability that produces higher-density images. Thus, two-component developing methods are widely employed in full-color and high-speed image forming apparatuses.

In a typical two-component developing method, a linear speed (Vr) of a developing sleeve is greater than a linear speed (Vp) of an image bearing member. This causes undesirable image density variation or white blanks in the edge portions of an image in which the latent image potential is discontinuously and drastically changed.

In a case in which the image bearing member and the developing sleeve rotate in the same direction and the linear speed of the developing sleeve is greater than the linear speed of the image bearing member, developer particles (i.e., carrier particles holding toner particles thereon) on the developing sleeve are always ahead of an electrostatic latent image on the image bearing member. Therefore, when viewed from a boundary between a background portion and a solid image portion in the electrostatic latent image, the developer particles have already passed through the background portion. As a result, most of the toner particles held on the carrier particles migrates to the developing sleeve disposed on the opposite side of the background portion of the electrostatic latent image on the image bearing member due to background potential, i.e., VD (charged potential)−VB (direct current bias), leaving only a small amount of toner particles on the carrier particles which are contacting the image bearing member. The carrier particles are then given a charge opposite to that of the toner particles (hereinafter "counter charge").

Therefore, when developer particles reach the trailing edge of the solid image after passing through the background portion with respect to the moving direction of the electrostatic latent image, toner particles cannot be quickly supplied to the image bearing member. Thus, white blanks undesirably appear in the trailing edge of the solid image. White blanks more notably appear in a halftone image that has a smaller developing potential.

When the linear speed of the developing sleeve is greater than that of the image bearing member, various problems occur such that white blanks appear in the trailing edge of image, as described above, lateral lines get thin, vertical lines get thick, sharpness of texts decreases, and carrier particles are deposited on images.

In attempting to solve the above-described problems, an effective developing method in which a magnet contained in a developing sleeve is rotated at a high speed has been proposed. In this method, developer particles are conveyed to an area where an electrostatic latent image is developed into a toner image (hereinafter the "developing area") while being rotated. Therefore, toner particles held on carrier particles are prevented from migrating to the developing sleeve and counter charge is not likely to accumulate in the carrier particles, preventing the occurrence of the above-described problems.

However, this developing method has a drawback that toner particles are likely to fixedly adhere to carrier particles and covering layer of the carrier particles is easily abraded due to the active movement of the developer particles on the developing sleeve. Thus, the lifespan of the developer is undesirably shortened in this developing method.

On the other hand, in attempting to extend the lifespan of two-component developer, there has been a proposal to provide a low-surface-energy covering layer, comprised of a fluorine-based resin, silicone resin, or the like, on a core material of carrier.

Such a covering layer may include a conductive agent and a filler to control the resistance of the carrier and to improve the strength of the layer.

When the conductive agent or filler undesirably release from the covering layer, the resulting full-color image may be contaminated. To solve this problem, white conductive filler particles have been proposed. However, carriers using such white conductive particles do not have enough durability. Thus, in a developing method in which a magnet is rotated at a high speed, toner particles fixedly adhere to such carrier particles and the covering layer is easily abraded after a long period of use.

Because of these reasons, a developing method in which a magnet is rotated at a high speed which does not degrade developer has been demanded.

SUMMARY

Exemplary aspects of the present invention are put forward in view of the above-described circumstances, and provide novel contact developing method, image forming apparatus, and process cartridge that produce high quality images without image density variation, background fouling, toner scattering, and machine contamination regardless of environmental condition.

In one exemplary embodiment, a novel contact developing method includes supplying a two-component developer to an electrostatic latent image on a rotating image bearing member by rotating a developing sleeve and a rotatable magnet having multiple magnetic poles provided inside the developing sleeve, to develop the electrostatic latent image into a toner image. The developing sleeve and the image bearing member rotate in the same direction while facing each other. The two-component developer comprises a non-magnetic toner and a carrier. The carrier comprises a magnetic core particle and a resin layer covering the magnetic core particle. The resin layer comprises a conductive particle and a resin. The conductive particle comprises an alumina-based material and a conductive layer covering the alumina-based material. The resin is obtained by heating a copolymer comprising a monomer A unit having the following formula (1) and a monomer B unit having the following formula (2):

(1)

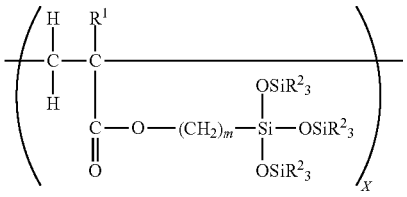

Monomer A unit (2)

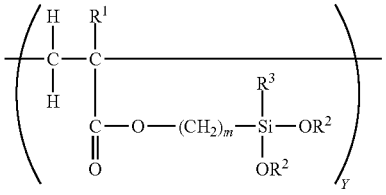

Monomer B unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, and each of X and Y represents a molar ratio (%) between 10 to 90.

In another exemplary embodiment, a novel image forming apparatus includes an image bearing member; a charger to charge the image bearing member; an irradiator to form an electrostatic latent image on the image bearing member; a developing device to develop the electrostatic latent image into a toner image by the above contact developing method; a transfer device to transfer the toner image from the image bearing member onto a recording medium; and a fixing device to fix the toner image on the recording medium.

In yet another exemplary embodiment, a novel process cartridge includes an image bearing member; a charger to charge the image bearing member; an irradiator to form an electrostatic latent image on the image bearing member; a developing device to develop the electrostatic latent image into a toner image by the above contact developing method; and a cleaning member to clean the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
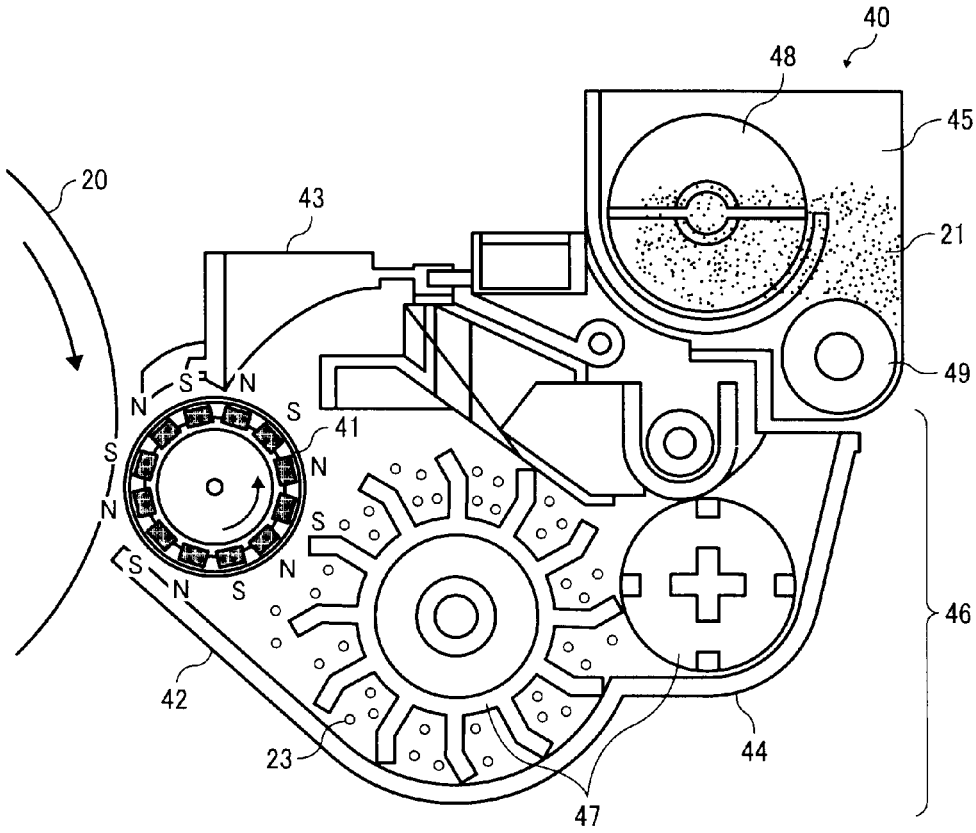
FIG. 1 is a cross-sectional view illustrating a developing device included in an image forming apparatus according to exemplary aspects of the invention.

Exemplary aspects of the present invention provides a contact developing method in which a two-component developer is supplied to an electrostatic latent image on a rotating image bearing member by rotating a developing sleeve and a rotatable magnet having multiple magnetic poles provided inside the developing sleeve, to develop the electrostatic latent image into a toner image. The developing sleeve and the image bearing member rotate in the same direction. The two-component developer comprises a non-magnetic toner and a carrier. The carrier comprises a core particle and a resin layer that covers the core particle. The resin layer comprises a conductive particle and a resin. The conductive particle comprises an alumina-based material and a conductive layer that covers the alumina-based material. The resin is obtained by heating a copolymer comprising a monomer A unit having an acrylic siloxane structure having a repellency group and a monomer B unit having an acrylic silicon structure having a silanol group or a silanol precursor group being able to condense by hydrolysis. The above contact developing method provides high quality images for an extended period of time without causing image density variation, background fouling, toner scattering, and machine contamination.

The carrier is obtained by covering the core particle with an acrylic copolymer including the conductive particle comprising an alumina-based material and a conductive layer, followed by heating. The acrylic copolymer is obtained by radical-polymerizing multiple radical-polymerizable monomers. Silane-based cross-linkable components in the acrylic copolymer are subjected to condensation polymerization by the heating.

When the magnet provided inside the developing sleeve is rotated at a high speed, a magnetic brush (i.e., formed from developer particles held on the developing sleeve) formed on the developing sleeve is conveyed thereon while rotating in the opposite direction to the direction of rotation of the magnet. Such rotation of the magnetic brush prevents toner particles from releasing from carrier particles in the developing area.

Thus, the counter charge does not accumulate in the carrier particles, preventing the occurrence of abnormal image such as white blanks in the trailing edge.

When the developer particles actively rotate on the developing sleeve, it is likely that toner particles fixedly adhere to the carrier particles and the covering layer of the carrier particles is easily abraded. To suppress such undesirable phenomenon, the two-component developer used in the above developing method comprises a carrier comprising a magnetic core particle and a resin layer covering the magnetic core particle. The resin layer comprises a conductive particle and a resin. The conductive particle comprises an alumina-based material and a conductive layer covering the alumina-based material, and the resin is obtained by heating a copolymer comprising a monomer A unit having the following formula (1) and a monomer B unit having the following formula (2):

(1)

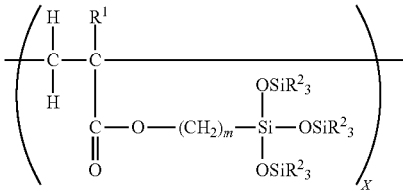

Monomer A unit (2)

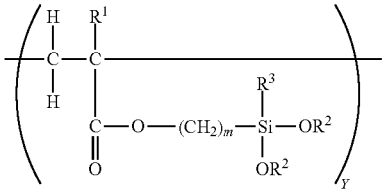

Monomer B unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, and each of X and Y represents a molar ratio (%) between 10 to 90.

Such a copolymer may be represented by the following formula (3):

(3)

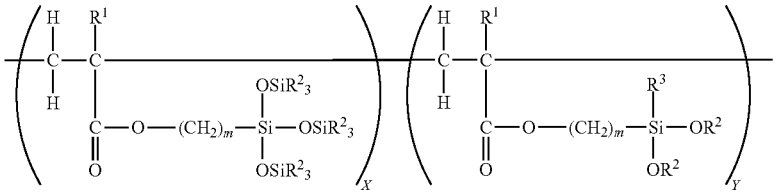

Monomer A unit Monomer B unit

In this developing method, an electrostatic latent image formed on the image bearing member is developed into a toner image at the developing area while a direct current bias is applied to the developing sleeve that rotates in the same direction as the image bearing member and that internally contains the rotatable magnet having multiple magnetic poles.

A time period during which the electrostatic latent image passes the developing area is represented by L/Vp (sec), wherein L (mm) represents the width of the developing area and Vp (mm/sec) represents the movement speed of the image bearing member. The width L (mm) of the developing area is defined as a length of a part of a circumferential surface of the image bearing member which faces the surface of the developing sleeve.

On the other hand, the number of times the magnetic poles pass the developing area per second is represented by KN/60, wherein K represents the number of the magnetic poles and N (rpm) represents the rotation number of the magnetic poles.

Accordingly, within the time period during which the electrostatic latent image passes the developing area, the magnetic poles pass the developing area for (L/Vp)×(KN/60) times.

To develop electrostatic latent images more uniformly in the direction of rotation of the image bearing member without causing nonuniform image density or white blanks in the trailing edge of image by improving developability in both lateral and vertical directions, preferably, at least one pair of north pole and south pole passes the developing sleeve while the electrostatic latent image passes the developing area, in other words, (L/Vp)×(KN/60)>2 is satisfied.

As (L/Vp)×(KN/60) becomes greater, in other words, as K and N become greater, the number of times the magnetic poles pass the developing area becomes greater, thus improving the resulting image quality. Because the magnet provided inside the developing sleeve is rotated, the magnetic brush is conveyed to the developing area while rotating on the developing sleeve. The magnetic brush rotates in the opposite direction to the direction of rotation of the magnet.

Preferably, the linear speed (Vr) of the developing sleeve is greater than the linear speed (Vp) of the image bearing member. The number of the magnetic poles is preferably 8 to 32, depending on the diameter of the developing sleeve. When the number of the magnetic poles is too small, the rotation number of the magnet has to be increased by undesirably increasing torque for driving the magnet. When the number of the magnetic poles is too large, magnetization may be nonuniform.

The rotation number of the magnet is preferably 300 to 4,000 rpm. When the rotation number is too small, the number of magnetic poles has to be increased. When the rotation number is too large, torque for driving the magnet is undesirably increased.

Each of the magnetic poles preferably has a magnetic flux density of 300 to 1,500 gauss. When the magnetic flux density is too small, carrier particles may deposit on the resulting image. When the magnetic flux density is too large, torque for driving the magnet may be increased.

Each of the magnetic poles needs not necessarily have the same size. However, preferably, each of the magnetic poles has a uniform magnetization.

When an alternating current bias, in which a time-varying alternating current bias component is overlapped with a direct current bias, is applied to the developing sleeve, effective values of both the developing and background potentials are increased to improve developability but carrier particles are undesirably deposited on the resulting image. When an alternating current bias is applied to the developing sleeve, the magnet provided inside the developing sleeve is not effectively rotated, causing more significant background fouling than in a case a direct current bias is applied.

Thus, in the developing method according to exemplary embodiments, a direct current bias is applied to the developing sleeve. Additionally, the developing method employs the above-described carrier having specific properties to prevent the occurrence of abnormal image and carrier deposition.

The resin that covers the core particle of the carrier is described in detail below.

The resin is obtained by heating an acrylic copolymer obtained by radical-polymerizing a monomer A unit having the following formula (1) and a monomer B unit having the following formula (2):

(1)

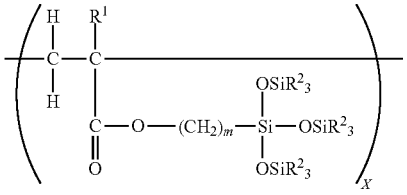

Monomer A unit (2)

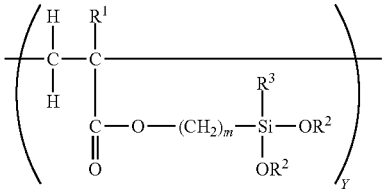

Monomer B unit wherein $R^2$ represents a hydrogen atom or a methyl group, m represents an integer of 1 to 8 (i.e., $(CH_2)m$ represents methylene group, ethylene group, propylene group, butylene group, etc.), $R^2$ represents an alkyl group having 1 to 4 carbon atoms (e.g., methyl group, ethyl group, propyl group, butyl group), $R^3$ represents an alkyl group having 1 to 8 carbon atoms (e.g., methyl group, ethyl group, propyl group, butyl group) or an alkoxy group having 1 to 4 carbon atoms (e.g., methoxy group, ethoxy group, propoxy group, butoxy group), and each of X and Y represents a molar ratio (%) between 10 to 90.

The molar ratio X (%) of the monomer A unit is preferably 10 to 90%, more preferably 10 to 40%, and most preferably 20 to 30%.

The monomer A unit has a tris(trimethylsiloxy)silane that is an atom group having multiple methyl groups on side chains. As the ratio of the monomer A unit increases in the resin, the surface energy of the resulting carrier becomes lower. A carrier having such a low surface energy is less adhesive to binder resin and/or wax of toner. When the molar ratio of the monomer A unit is too small, binder resin and/or wax of toner may considerably adhere to the resulting carrier. When the molar ratio of the monomer A unit is too large, the resin layer may have poor toughness and the adherence between the core particle and the resin layer may be too weak, degrading durability of the resulting carrier.

$R^2$ represents an alkyl group having 1 to 4 carbon atoms. Thus, specific examples of the monomer A include, but are not limited to, tris(trimethylsiloxy)silane compounds represented by the following formulae:

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ wherein Me, Et, and Pr respectively represents methyl group, ethyl group, and propyl group.

The monomer A may be obtained by, for example, reacting a tris(trimethylsiloxy)silane with aryl acrylate or aryl methacrylate in the presence of a platinum catalyst, or reacting methacryloxyalkyl trialkoxysilane with hexaalkyl disiloxane in the presence of a carboxylic acid and an acid catalyst as described in Japanese Patent Application Publication No. 11-217389, the disclosure thereof being incorporated herein by reference.

The monomer B may be, for example, a radical-polymerizable difunctional silane compound (when $R^3$ is an alkyl group) or a radical-polymerizable trifunctional silane compound (when $R^3$ is an alkoxy group). The molar ratio Y (%) of the monomer B unit is preferably 10 to 90%, more preferably 10 to 80%, and most preferably 15 to 70%.

When the molar ratio of the monomer B unit is too small, the resin layer may have poor toughness. When the molar ratio of the monomer B unit is too large, the resin layer may be so stiff and brittle that abrasion may be caused. Additionally, environmental stability (humidity dependence) may be poor because a large number of silanol groups generated from hydrolyzed cross-linked components may remain.

Specific examples of the monomer B include, but are not limited to, 3-methacryloxypropyl trimethoxysilane, 3-acryloxypropyl trimethoxysilane, 3-methacryloxypropyl triethoxysilane, 3-acryloxypropyl triethoxysilane, 3-methacryloxypropyl methyldimethoxysilane, 3-methacryloxypropyl methyldiethoxysilane, 3-methacryloxypropyl tri(isopropoxy)silane, and 3-acryloxypropyl tri(isopropoxy)silane.

In attempting to improve durability of carrier, there has been a proposal to form a cross-linked resin layer on a core particle. For example, Japanese Patent No. 3691115 describes a carrier having a covering layer including a thermosetting resin obtained by cross-linking a copolymer of an organopolysiloxane having a terminal vinyl group and a radical-polymerizable monomer having at least one of hydroxyl group, amino group, amide group, and imide group, with an isocyanate compound. However, this carrier is not resistant to peeling off or abrasion of the resin layer.

This is because the number of functional groups (i.e., active-hydrogen-containing groups such as amino group, hydroxyl group, carboxyl group, mercapto group) per unit weight of the copolymer to be cross-linked with the isocyanate compound is too small to form dense two-dimensional or three-dimensional cross-linking structure. Such a resin layer may peel off from the core particle or may be abraded after a long term of use.

Peeing off or abrasion of the resin layer reduces resistance of the carrier, resulting in poor-quality image with carrier deposition. Peeing off or abrasion of the resin layer also reduces fluidity of developer, resulting in poor-quality image with low image density, background fouling, and/or toner scattering.

The copolymer according to exemplary embodiments includes about 2 to 3 times the number of difunctional or trifunctional cross-linkable functional groups per unit weight than the above resin, and is further subjected to cross-linking by condensation polymerization. Thus, the resulting resin layer is tough and not abraded.

Additionally, siloxane cross-linking bonds have greater binding energy and are more resistant to thermal stress than isocyanate cross-linking bonds, providing better temporal stability.

To improve flexibility and adhesiveness between the core particle and the resin layer and between the resin layer and the conductive particle, the above-described copolymer having the formula (3) may further include a monomer C unit having the following formula (4):

(4)

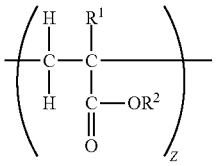

Monomer C unit wherein R1 represents a hydrogen atom or a methyl group and R2 represents an alkyl group having 1 to 4 carbon atoms (e.g., methyl group, ethyl group, propyl group, butyl group). Thus, the monomer C may be a radical-polymerizable acrylic compound.

Such a copolymer may be represented by the following formula (5):

(5)

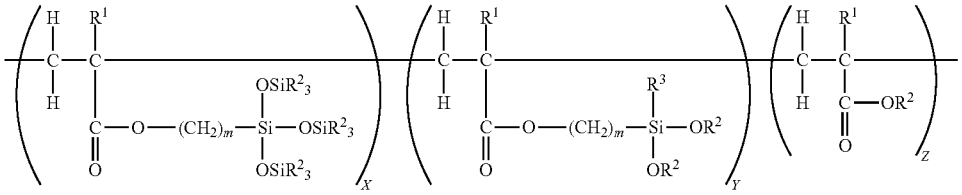

Monomer A unit Monomer B unit Monomer C unit

When the copolymer has the monomer C unit, preferably, the molar ratio X (%) of the monomer unit A is 10 to 40%; the molar ratio Y (%) of the monomer unit B is 10 to 40%; the molar ratio Z (%) of the monomer unit C is 30 to 80%, more preferably 35 to 75%; and 60%<Y+Z<90%, more preferably 70%<Y+Z<85% is satisfied.

When the molar ratio Z (%) of the monomer unit C is too large, the molar ratio X (%) of the monomer unit A or the molar ratio Y (%) of the monomer unit B becomes too small. As a result, the resulting resin layer cannot achieve a good balance between repellency, stiffness, and flexibility.

Specific examples of acrylic compounds suitable for the monomer C include, but are not limited to, acrylates and methacrylates such as methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino) ethyl methacrylate, and 2-(diethylamino)ethyl acrylate. Among these compounds, alkyl methacrylates are preferable and methyl acrylate is most preferable. Two or more of these compounds can be used in combination.

The above-described copolymer according to exemplary embodiments is an acrylic copolymer obtained by radical-polymerizing the monomers A, B, and optional C. This copolymer has a large number of cross-linkable functional groups per unit weight of the copolymer, and is further subjected to condensation polymerization by heating. Thus, the resulting resin layer is tough and not abraded.

Additionally, siloxane cross-linking bonds have greater binding energy and are more resistant to thermal stress than isocyanate cross-linking bonds, providing better temporal stability.

The resin layer preferably includes a silicone resin having a silanol group and/or a functional group that generates a silanol group by hydrolysis (e.g., a negative group such as an alkoxy group and a halogeno group binding to Si atom). Such a silicone resin can be directly condensation-polymerized with the monomer B unit in the copolymer. The copolymer having the silicone resin component is less adhesive to toner.

The silicone resin having a silanol group and/or a functional group that generates a silanol group by hydrolysis preferably has at least one of the repeating units having the following formula (I):

(I)

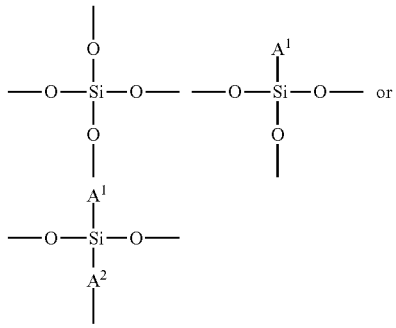

wherein $A^1$ represents a hydrogen atom, a halogen atom, a hydroxyl group, a methoxy group, a lower alkyl group having 1 to 4 carbon atoms, or an aryl group (e.g., phenyl group, tolyl group), and $A^2$ represents an alkylene group having 1 to 4 carbon atoms or an arylene group (e.g., phenylene group).

In the formula (I), the aryl group preferably has 6 to 20 carbon atoms, more preferably 6 to 14 carbon atoms. The aryl group may be, for example, an aryl group derived from benzene (i.e., phenyl group); an aryl group derived from a condensed polycyclic aromatic hydrocarbon such as naphthalene, phenanthrene, and anthracene; or an aryl group derived from a chained polycyclic aromatic hydrocarbon such as biphenyl and terphenyl. The aryl group may have a substituent.

In the formula (I), the arylene group preferably has 6 to 20 carbon atoms, more preferably 6 to 14 carbon atoms. The arylene group may be, for example, an arylene group derived from benzene (i.e., phenylene group); an arylene group derived from a condensed polycyclic aromatic hydrocarbon such as naphthalene, phenanthrene, and anthracene; or an arylene group derived from a chained polycyclic aromatic hydrocarbon such as biphenyl and terphenyl. The arylene group may have a substituent.

Specific examples of usable commercially available silicone resins include, but are not limited to, KR251, KR271, KR272, KR282, KR252, KR255, KR152, KR155, KR211, KR216, and KR213 (from Shin-Etsu Chemical Co., Ltd.); and AY42-170, SR2510, SR2400, SR2406, SR2410, SR2405, and SR2411 (from Dow Corning Toray Co., Ltd.).

Among various silicone resins, methyl silicone resins are preferable because they are less adhesive to toner and their charge is less susceptible to environmental fluctuation.

The silicone resin preferably has a weight average molecular weight of 1,000 to 100,000, more preferably 1,000 to 30,000. When the weight average molecular weight is too large, the resulting resin layer may be not uniform because the coating liquid has too large a viscosity. Moreover, the hardened resin layer may have a low density. When the weight average molecular weight is too small, the hardened resin layer may be too brittle.

The content of the silicone resin is preferably 5 to 80% by weight, more preferably 10 to 60% by weight, based on the copolymer. When the content of the silicone resin is too small, the resulting resin layer may be adhesive to toner. When the content of the silicone resin is too large, the resulting resin layer may have poor toughness and may be easily abraded.

The resin layer may further include a silane coupling agent to improve dispersibility of conductive particles and to control charge of toner.

Specifically, to control charge of toner, an aminosilane coupling agent in an amount of 0.001 to 30% by weight based on the silicone resin is preferably included in the resin layer.

Specific examples of suitable aminosilane coupling agents are listed below.

| | |
|---|---|
| $H_2N(CH_2)_3Si(OCH_2)_3$ | MW 179.3 |
| $H_2N(CH_2)_3Si(OC_2H_3)_3$ | MW 221.4 |
| $H_2NCH_2CH_2CH_2Si(CH_3)_2(OC_2H_5)$ | MW 161.3 |
| $H_2NCH_2CH_2CH_2Si(CH_3)(OC_2H_5)_2$ | MW 191.3 |
| $H_2NCH_2CH_2NHCH_2Si(OCH_3)_3$ | MW 194.3 |
| $H_2NCH_2CH_2NHCH_2CH_2CH_2Si(CH_3)(OCH_3)_2$ | MW 206.4 |
| $H_2NCH_2CH_2NHCH_2CH_2CH_2Si(OCH_3)_3$ | MW 224.4 |
| $(CH_3)_2NCH_2CH_2CH_2Si(CH_3)(OC_2H_5)_2$ | MW 219.4 |
| $(C_4H_9)_2NC_3H_6Si(OCH_3)_3$ | MW 291.6 |

(MW: Molecular weight)

The resin layer may further include resins other than the silicone resin having a silanol group and/or a functional group that generates a silanol group by hydrolysis. Specific examples of usable resins include, but are not limited to, acrylic resins, amino resins, polyvinyl resins, polystyrene resins, halogenated olefin resins, polyester, polycarbonate, polyethylene, polyvinyl fluoride, polyvinylidene fluoride, poly(trifluoroethylene), poly(hexafluoropropylene), copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable group. Two or more of these resins can be used in combination. Among these resins, acrylic resins are preferable because they are adhesive to the core particle and conductive particle while being less brittle.

The acrylic resin preferably has a glass transition temperature of 20 to 100° C., more preferably 25 to 80° C. Such an acrylic resin has proper elasticity. When the carrier frictionally charges toner, the resin layer receives strong impact due to friction between toner particle and carrier particle, or between carrier particles. The acrylic resin having proper elasticity absorbs the impact and thus prevents deterioration of the resin layer.

Further, the resin layer preferably includes a cross-linked material between an acrylic resin and an amino resin. Such a resin layer has proper elasticity and prevents fusion between resin layers. Specific examples of usable amino resins include, but are not limited to, melamine resins and benzoguanamine resins, which can improve charge giving ability of the resulting carrier. To more properly control the charge giving ability of the resulting carrier, a melamine resin and/or a benzoguanamine resin are/is preferably used in combination with another amino resin.

Acrylic resins which form cross-links between the amino resins preferably include a hydroxyl group and/or a carboxyl group, more preferably a hydroxyl group. In this case, both adhesiveness between the resin layer and the core particle or conductive particle, and dispersion stability of the conductive particle are improved. The acrylic resin preferably has a hydroxyl value of 10 mgKOH/g or more, and more preferably 20 mgKOH/g or more.

To accelerate condensation reaction of the monomer unit B, titanium-based catalysts, tin-based catalysts, zirconium-based catalysts, or aluminum-based catalysts can be used. Among these catalysts, titanium-based catalysts are preferable. More specifically, titanium alkoxide catalysts and titanium chelate catalysts are preferable.

The above catalysts effectively accelerate condensation reaction of silanol group derived from the monomer B unit, while keeping good catalytic ability. Specific examples of the titanium alkoxide catalysts include, but are not limited to, titanium diisopropoxy bis(ethylacetoacetate) having the following formula (6). Specific examples of the titanium chelate catalysts include, but are not limited to, titanium diisopropoxy bis(triethanolaminate) having the following formula (7).

$$Ti(O\text{-}i\text{-}C_3H_7)_2(C_6H_9O_3)_2 \quad (6)$$

$$Ti(O\text{-}i\text{-}C_3H_7)_2(C_6H_{14}O_3N)_2 \quad (7)$$

Thus, the resin layer can be formed from a resin layer composition including a solvent, the copolymer having the monomer A unit and the monomer B unit, the titanium diisopropoxy bis(ethylacetoacetate) catalyst, and optional resins, for example.

The resin layer may be formed by subjecting silanol groups to condensation reaction by applying heat or light, while the core particle is covered with the resin layer composition. Alternatively, the resin layer may be formed by subjecting silanol groups to condensation reaction by applying heat, after the core particles has been covered with the resin layer composition.

Generally, high-molecular-weight resins have high viscosity, and therefore it is difficult to uniformly apply such resins to small-diameter particles without causing aggregation.

Therefore, the copolymer preferably has a weight average molecular weight of 5,000 to 100,000, more preferably 10,000 to 70,000, and most preferably 30,000 to 40,000. When the weight average molecular weight is too small, the resin layer may have poor strength. When the weight average molecular weight is too large, viscosity of the coating liquid may be so large that manufacturability decreases.

For the purpose of improving strength of the resin layer and controlling resistance of the carrier, the resin layer includes a conductive particle comprising an alumina-based material and a conductive layer covering the alumina-based material.

The conductive particle comprising an alumina-based material and a conductive layer that covers the alumina-based material has high ability to control volume resistivity of the carrier having the resin layer obtained by heating the copolymer having the monomer A unit and the monomer B unit. This is because such a conductive particle has high compatibility with the copolymer having a low surface energy and high toughness. Thus, the carrier can keep constant resistivity and toner supplying ability for an extended period of time.

Because the carrier frictionally charges toner, the difference between the electronegativities of the base material of the carrier and the toner is preferably as large as possible. Because the toner has external additives having a large electronegativity, such as silica or titanium oxide, on its surface, the toner is negatively chargeable. Therefore, the base material of the carrier preferably has a smaller electronegativity to charge the negative-chargeable toner. When an alumina-based material having a small electronegativity is used as the base material of the carrier, the carrier constantly and reliably charges the toner and produces high-quality images for an extended period of time. By contrast, when a material having a large electronegativity, such as titanium oxide, is used as the base material of the carrier, the carrier cannot constantly and reliably charges the toner after a long term of use, producing low-quality images.

Specific examples of usable alumina include, but are not limited to, α-alumina, β-alumina, and γ-alumina. The alumina preferably has an average particle diameter of 0.1 to 5 μm and a BET specific surface area of 5 to 30 $m^2/g$.

The conductive layer of the conductive particle preferably includes tin dioxide or a combination of tin dioxide and indium oxide. Such a conductive layer including tin dioxide or a combination of tin dioxide and indium oxide uniformly covers the surface of the base material and provides good conductivity regardless of the kind of the base material. The conductive layer including tin dioxide is more advantageous in terms of resistance controlling ability and cost.

When the conductive layer includes tin dioxide, the content of tin dioxide is preferably 4 to 80% by weight, more preferably 30 to 50% by weight, based on total weight of the conductive particle.

When the content of tin dioxide is too small, volume resistivity of the conductive particle is too high. Thus, the content of the conductive particle in the resin layer of the carrier is so increased that the conductive particles easily release from the carrier. When the content of tin dioxide is too large, volume resistivity of the conductive particle is too low and nonuniform.

When the conductive layer includes a combination of tin dioxide and indium oxide, the content of tin dioxide is preferably 2 to 7% by weight and the content of indium oxide is preferably 15 to 40% by weight, based on total weight of the conductive particle.

The carrier preferably has a volume resistivity of $1\times10^{10}$ Ω·cm to $1\times10^{17}$ Ω·cm. Such a carrier produces high definition images with high thin-line reproducibility without color contamination. When the volume resistivity is too small, the resin layer may be abraded after a long term of use, causing carrier deposition. When the volume resistivity is too large, an unacceptable degree of the edge effect may occur.

The volume resistivity of the carrier is controlled by controlling the resistance or thickness of the resin layer on the core particle. The resistance of the resin layer is controlled by changing the amount of the conductive particle added. Preferably, the resin layer includes the conductive particle in an amount of 5 to 200 parts by weight based on 100 parts by weight of the resin.

When the amount of the conductive particle is too small, the resin layer may have poor strength and the resistance cannot be well controlled. When the amount of the conductive particle is too large, the conductive particle may easily release from the carrier.

The core particle covered with the resin composition is heated at a temperature less than the Curie point of the core particle, preferably at 100 to 350° C., more preferably at 150 to 250° C., so that cross-linking reaction (i.e., condensation reaction) is accelerated.

When the heating temperature is too low, the cross-linking reaction may not proceed and the resulting layer may have poor strength.

When the heating temperature is too high, the copolymer may become carbonized and the resulting layer may be easily abraded.

The resin layer of the carrier preferably has an average thickness of 0.05 to 4 μm. When the average thickness is too small, the resin layer may easily peel off. When the average thickness is too large, the carrier may easily adhere to images because the resin layer has no magnetic property.

The average thickness of the resin layer can be measured by observing a cross-section of the carrier by a transmission electron microscope (TEM).

The core particle of the carrier is a magnetic material. Specific preferred examples of suitable magnetic materials for the core particle include, but are not limited to, ferromagnetic materials (e.g., iron, cobalt), iron oxides (e.g., magnetite, hematite, ferrite), alloys, and resin particles in which magnetic materials are dispersed. Among these materials, Mn ferrite, Mn—Mg ferrite, and Mn—Mg—Sr ferrite are preferable because they are environmentally-friendly.

The core particle preferably has a weight average particle diameter (Dw) of 20 to 65 μm. When Dw is too large, granularity of the resulting image may be poor because a latent image cannot be faithfully developed, even though carrier deposition is not likely to occur. Additionally, background fouling may occur when the toner concentration is high.

The carrier deposition is a phenomenon in which carrier particles are deposited on image or background portion of an electrostatic latent image.

The carrier deposition is more likely to occur in a stronger electric field. The electric field in the image portion onto which toner is adhered is weaker than that in the background portion. Thus, the carrier deposition is more likely to occur in the background portion.

In this specification, the weight average particle diameter (Dw) of the carrier, core particle, or toner is calculated based on a particle diameter distribution by number (i.e., a relation between number frequency and particle diameter) and is represented by the following formula:

$$Dw=\{1/\Sigma(nD^3)\}\times\{\Sigma(nD^4)\}$$

wherein D represents a representative particle diameter (μm) of particles present in each channel and n represents the number of the particles present in each channel. The channel represents a unit length that divides the measuring range of particle diameter into a measuring unit width. In this specification, the channel has a length of 2 μm.

The minimum particle diameter present in each channel is employed as the representative particle diameter.

The carrier preferably has a magnetization of 40 to 90 $Am^2/kg$ in a magnetic field of 1 kOe ($10^6/4\pi$[A/m]). When the magnetization is too small, carrier deposition may occur. When the magnetization is too large, the magnetic brush may be so stiff that the resulting image has blurring.

The carrier is mixed with a toner to be used as a two-component developer.

The toner comprises a binder resin (e.g., a thermoplastic resin), a colorant, a charge controlling agent, a release agent, fine particles, etc. The toner may be obtained by various manufacturing methods such as polymerization methods and granulation methods, and have either an irregular or spherical shape. The toner may be either magnetic or non-magnetic.

Specific examples of usable binder resins for the toner include, but are not limited to, styrene-based resins (e.g., homopolymers of styrene or styrene derivatives such as polystyrene and polyvinyl toluene; and styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleate copolymer), acrylic resins (e.g., polymethyl methacrylate, polybutyl methacrylate), polyvinyl chloride, polyvinyl acetate, polyethylene, polypropylene, polyester, polyurethane, epoxy resin, polyvinyl butyral, polyacrylic acid resin, rosin, modified rosin, terpene resin, phenol resin, aliphatic or alicyclic hydrocarbon resin, aromatic petroleum resin, chlorinated paraffin, and paraffin wax. Two or more of these resins can be used in combination.

Among these resins, polyester resins are preferable because they can have lower viscosity when melted while keeping better storage stability than styrene-based or acrylic resins.

The polyester resin can be obtained from a polycondensation reaction between an alcohol and a carboxylic acid.

Specific examples of suitable alcohols include, but are not limited to, diols (e.g., polyethylene glycol, diethylene glycol, triethylene glycol, 1,2-propylene glycol, 1,3-propylene glycol, 1,4-propylene glycol, neopentyl glycol, 1,4-butenediol), etherified bisphenols (e.g., 1,4-bis(hydroxymethyl)cyclohexane, bisphenol A, hydrogenated bisphenol A, polyoxyethylenated bisphenol A, polyoxypropylenated bisphenol A), divalent alcohols in which the above compounds are substituted with a saturated or unsaturated hydrocarbon group having 3 to 22 carbon atoms, other divalent alcohols, and tri- or more valent alcohols (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene).

Specific examples of suitable carboxylic acids include, but are not limited to, monocarboxylic acids (e.g., palmitic acid, stearic acid, oleic acid), maleic acid, fumaric acid, mesaconic acid, citraconic acid, terephthalic acid, cyclohexanedicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid enpol trimmer acid, and anhydrides of these compounds).

An epoxy resin can be obtained from polycondensation between bisphenol A and epichlorohydrin. Specific examples of commercially available epoxy resins include, but are not limited to, EPOMIK R362, R364, R365, R366, R367, and R369 (from Mitsui Chemicals, Inc.), EPOTOHTO YD-011, YD-012, YD-014, YD-904, and YD-017, (from Nippon Steel Chemical Co., Ltd.), and EPIKOTE 1002, 1004, and 1007 (from Shell Chemicals).

Specific examples of usable colorants include, but are not limited to, carbon black, lamp black, iron black, Ultramarine Blue, Nigrosine dyes, Aniline Blue, Phthalocyanine Blue, Hansa Yellow G, Rhodamine 6G Lake, Calco Oil Blue, Chrome Yellow, Quinacridone, Benzidine Yellow, Rose Bengal, triarylmethane dyes, monoazo and disazo dyes and pigments. Two or more of such colorants can be used in combination.

Black toner may include a magnetic material to be used as a magnetic toner. Specific examples of usable magnetic materials include, but are not limited to, powders of ferromagnetic materials (e.g., iron, cobalt), magnetite, hematite, Li ferrite, Mn—Zn ferrite, Cu—Zn ferrite, Ni—Zn ferrite, and Ba ferrite.

The toner may include a charge controlling agent to improve frictional chargeability. Specific examples of usable charge controlling agents include, but are not limited to, metal complex salts of monoazo dyes, nitrohumic acid and salts thereof, metal complex of salicylic acid, naphthoic acid, and dicarboxylic acid with Co, Cr, Ce, etc., amino compounds, quaternary ammonium compounds, and organic dyes.

Preferably, the toners having colors other than black include a white metal salt of a salicylic acid derivative.

The toner may include a release agent. Specific examples of usable release agents include, but are not limited to, low-molecular-weight polypropylene, low-molecular-weight polyethylene, carnauba wax, microcrystalline wax, jojoba wax, rice wax, montan wax. Two or more of these release agents can be used in combination.

The toner may externally include a fluidizer. The toner having proper fluidity produces high quality images. For example, fine particles of hydrophobized metal oxides, lubricants, metal oxides, organic resins, and metal salts may be externally added to the toner. Specific examples of suitable fluidizers include, but are not limited to, lubricants such as fluorocarbon resins (e.g., polytetrafluoroethylene) and zinc stearate; abrasive agents such cerium oxide and silicon carbide; inorganic oxides such as $SiO_2$ and $TiO_2$, the surfaces of which may be hydrophobized; caking preventing agents; and the above compounds of which surfaces are treated. Among various compounds, hydrophobized silica is preferable as a fluidizer.

The toner preferably has a weight average particle diameter of 3.0 to 9.0 μm, and more preferably 3.0 to 6.0 μm. Particle diameter of the toner can be measured by COULTER MULTIZIZER II (from Beckman Coulter, Inc.).

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a cross-sectional view illustrating a developing device included in an image forming apparatus according to exemplary aspects of the invention.

A developing device 40 is provided facing a photoreceptor 20 serving as an image bearing member. The developing device 40 includes a developing sleeve 41 serving as a developer bearing member, a developer container 42, a doctor blade 43 serving as a regulation member, and a support casing 44.

The support casing 44 has an opening on a side facing the photoreceptor 20. A toner hopper 45 serving as a toner container that contains toner particles 21 is attached to the support casing 44. A developer containing part 46 contains a developer comprising the toner particles 21 and carrier particles 23. A developer agitator 47 agitates the toner particles 21 and carrier particles 23 to frictionally charge the toner particles 21.

A toner agitator 48 and a toner supplying mechanism 49 each rotated by riving means, not shown, are provided in the toner hopper 45.

The toner agitator 48 and the toner supplying mechanism 49 agitate and supply the toner particles 21 in the toner hopper 45 toward the developer containing part 46.

The developing sleeve 41 is provided within a space between the photoreceptor 20 and the toner hopper 45. The developing sleeve 41 is driven to rotate counterclockwise in FIG. 1 by a driving means, not shown. The developing sleeve 41 internally contains a magnet serving as a magnetic field generator. The relative position of the magnet to the developing device 40 remains unchanged. The magnet is a rotatable cylindrical ferrite magnet having 12 magnetic poles, the surface of which has a magnetization of 800 Gauss, that rotates within the developing sleeve at 2,000 rpm or less.

The doctor blade 43 is integrally provided to the developer container 42 on the opposite side of the support casing 44. A constant gap is formed between the tip of the doctor blade 43 and the circumferential surface of the developing sleeve 41.

In a developing method according to exemplary aspects of the invention, the toner agitator 48 and the toner supplying mechanism 49 feed the toner particles 21 from the toner hopper 45 to the developer containing part 46. The developer agitator 47 agitates the toner particles 21 and the carrier particles 23 to frictionally charge the toner particles 21. The developing sleeve 41 bears the charged toner particles 21 and conveys them to a position where faces an outer peripheral surface of the photoreceptor 20 by rotation. The toner particles 21 then electrostatically bind to an electrostatic latent image formed on the photoreceptor 20. Thus, a toner image is formed on the photoreceptor 20.

Figure 2:
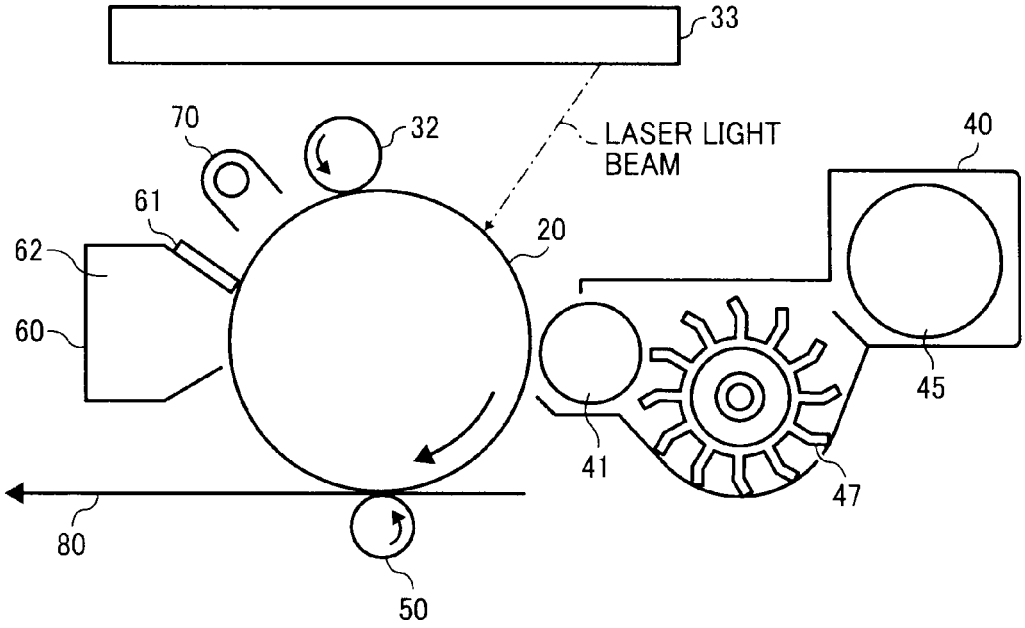
FIG. 2 is a cross-sectional view illustrating an image forming apparatus according to exemplary aspects of the invention.

FIG. 2 is a cross-sectional view illustrating an image forming apparatus according to exemplary aspects of the invention. Around a photoreceptor 20, a charging member 32, an irradiator 33, a developing device 40, a transfer member 50, a cleaning device 60, and a neutralization lamp 70 are provided. A surface of the charging member 32 forms a gap of about 0.2 mm between a surface of the photoreceptor 20. When an electric filed in which an alternating current component is overlapped with a direct current component is applied to the charging member 32 from a voltage applying mechanism, not shown, the photoreceptor 20 can be uniformly charged.

This image forming apparatus employs a negative-positive image forming process. The photoreceptor 20 having an organic photoconductive layer is neutralized by the neutralization lamp 70, and then negatively charged by the charging member 32. The charged photoreceptor 20 is irradiated with a laser light beam emitted from the irradiator 33 to form an electrostatic latent image thereon. In this embodiment, the absolute value of the potential of the irradiated portion is lower than that of the non-irradiated portion.

The laser light beam is emitted from a semiconductive laser. A polygon mirror that is a polygonal column rotating at a high speed scans the surface of the photoreceptor 20 with the laser light beam in the axial direction. The electrostatic latent image thus formed is then developed into a toner image with a developer supplied to a developing sleeve 41 in the developing device 40. When developing electrostatic latent image, a developing bias that is a predetermined voltage or that overlapped with an alternating current voltage is applied from a voltage applying mechanism, not shown, to between the developing sleeve 41 and the irradiated and non-irradiated portions on the photoreceptor 20.

On the other hand, a transfer medium 80 (e.g., paper, an intermediate transfer medium) is fed from a paper feed mechanism, not shown. A pair of registration rollers, not shown, feeds the transfer medium 80 to a gap between the photoreceptor 20 and the transfer member 50 in synchronization with an entry of the toner image to the gap so that the toner image is transferred onto the transfer medium 80. When transferring toner image, a transfer bias that is a voltage having the opposite polarity to the toner charge is applied to the transfer member 50. Thereafter, the transfer medium 80 separates from the photoreceptor 20.

Toner particles remaining on the photoreceptor 20 are removed by a cleaning blade 61 and collected in a toner collection chamber 62 in the cleaning device 60.

The collected toner particles may be referred to the developing device 40 by a recycle mechanism, not shown.

The image forming apparatus may include multiple developing devices. In this case, multiple toner images are sequentially transferred onto a transfer medium to form a composite toner image, and the composite toner image is finally fixed on the transfer medium. The image forming apparatus may further include and an intermediate transfer member. In this case, multiple toner images are transferred onto the intermediate transfer member to form a composite toner image, and the composite toner image is then transferred onto and fixed on a transfer medium.

Figure 3:
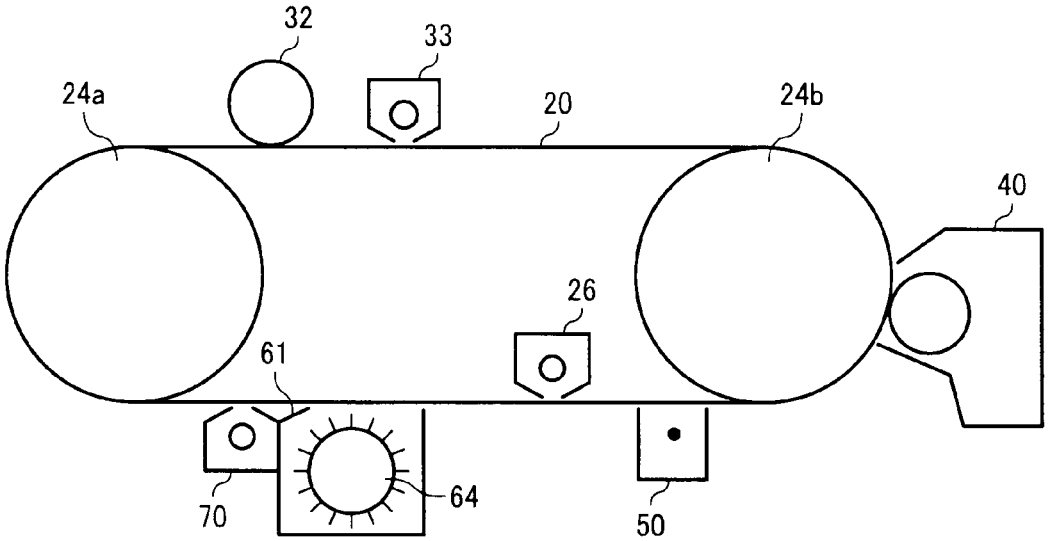
FIG. 3 is a cross-sectional view illustrating another image forming apparatus according to exemplary aspects of the invention.

FIG. 3 is a cross-sectional view illustrating another image forming apparatus according to exemplary aspects of the invention. A photoreceptor 20 having a conductive substrate and a photosensitive layer is driven by driving rollers 24*a* and 24*b*. The photoreceptor 20 is repeatedly subjected to processes of charging by a charging member 32, irradiation by an irradiator, development by a developing device 40, transfer by a transfer member 50, pre-cleaning irradiation by a light source 26, cleaning by a cleaning brush 64 and a cleaning blade 61, and neutralization by a neutralization lamp 70. In the pre-cleaning irradiation process, light is emitted from the back side of the photoreceptor 20. Therefore, in this embodiment, the conductive substrate is translucent.

Figure 4:
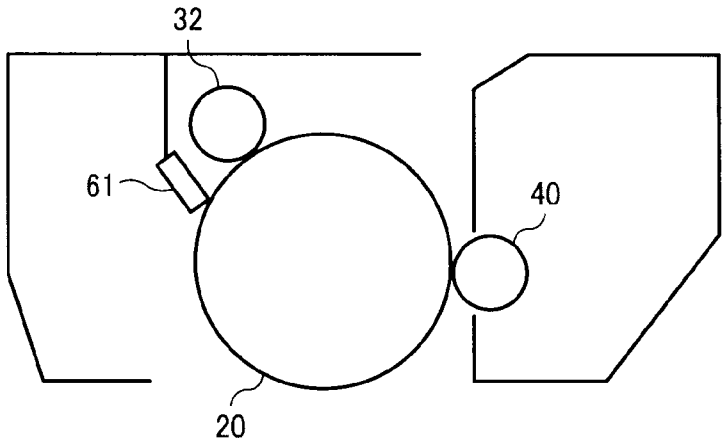
FIG. 4 is a cross-sectional view illustrating a process cartridge according to exemplary aspects of the invention.

FIG. 4 is a cross-sectional view illustrating a process cartridge according to exemplary aspects of the invention. The process cartridge integrally supports a photoreceptor 20, a charging member 32, a developing device 40, and a cleaning blade 61. The process cartridge is detachably attachable to image forming apparatuses.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Copolymers

In the following descriptions, weight average molecular weights are measured by a gel permeation chromatography and converted using standard polystyrenes. Viscosities are measured by a method according to JIS-K2283 at 25° C. Nonvolatile contents are calculated from the following equation:

$$\text{Nonvolatile content (\%)}=W(1)\times 100/W \quad (2)$$

wherein W(1) represents a weight of a sample which has been heated for 1 hour at 150° C. in an aluminum pan and W(2) represents a weight of the sample which has not been heated, i.e., 1 g.

Resin Manufacturing Example 1

A flask equipped with a stirrer is charged with 300 g of toluene and heated to 90° C. under nitrogen gas flow. A mixture of 84.4 g (i.e., 200 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE™-0701T from Chisso Corporation), 39 g (i.e., 150 mmol) of 3-methacryloxypropyl methyldiethoxysilane, 65.0 g (i.e., 650 mmol) of methyl methacrylate, and 0.58 g (i.e., 3 mmol) of 2,2'-azobis-2-methylbutylonitrile is dropped in the flask over a period of 1 hour. Further, a solution of 0.06 g (i.e., 0.3 mmol) of 2,2-azobis-2-methylbutylonitrole dissolved in 15 g of toluene is added to the flask. (The total amount of 2,2-azobis-2-methylbutylonitrole is 0.64 g, i.e., 3.3 mmol.) The mixture is then agitated for 3 hours at 90 to 100° C. to be subjected to radical polymerization. Thus, a resin 1 that is a methacrylic copolymer is prepared.

The resin 1 has a weight average molecular weight of 33,000. The resin 1 is diluted with toluene so that the diluted solution has 25% by weight of nonvolatile contents.

The diluted toluene solution of the resin 1 has a viscosity of 8.8 $mm^2/s$ and a specific weight of 0.91.

Resin Manufacturing Example 2

The procedure for preparing the resin 1 is repeated except for replacing the 39 g (i.e., 150 mmol) of 3-methacryloxypropyl methyldiethoxysilane with 37.2 g (i.e., 150 mmol) of 3-methacryloxypropyl trimethoxysilane. Thus, a resin 2 that is a methacrylic copolymer is prepared.

The resin 2 has a weight average molecular weight of 34,000. The resin 2 is diluted with toluene so that the diluted solution has 25% by weight of nonvolatile contents.

The diluted toluene solution of the resin 2 has a viscosity of 8.7 $mm^2/s$ and a specific weight of 0.91.

Resin Manufacturing Example 3

A flask equipped with a stirrer is charged with 500 g of toluene and heated to 90° C. under nitrogen gas flow. A mixture of 126.6 g (i.e., 300 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE™-0701T from Chisso Corporation), 173.6 g (i.e., 700 mmol) of 3-methacryloxypropyl trimethoxysilane, and 0.58 g (i.e., 3 mmol) of 2,2'-azobis-2-methylbutylonitrile is dropped in the flask over a period of 1 hour. Further, a solution of 0.06 g (i.e., 0.3 mmol) of 2,2-azobis-2-methylbutylonitrole dissolved in 15 g of toluene is added to the flask. (The total amount of 2,2-azobis-2-methylbutylonitrole is 0.64 g, i.e., 3.3 mmol.) The mixture is then agitated for 3 hours at 90 to 100° C. to be subjected to radical polymerization. Thus, a resin 3 that is a methacrylic copolymer is prepared.

The resin 3 has a weight average molecular weight of 35,000. The resin 3 is diluted with toluene so that the diluted solution has 25% by weight of nonvolatile contents.

The diluted toluene solution of the resin 3 has a viscosity of 8.5 $mm^2/s$ and a specific weight of 0.91.

Resin Manufacturing Example 4

A 500-ml flask equipped with a stirrer, a condenser, a thermometer, a nitrogen inlet pipe, and a dropping device is charged with 100 parts of MEK (methyl ethyl ketone). A solution in which 32.6 parts of MMA (methyl methacrylate), 2.5 parts of HEMA (2-hydroxyethyl methacrylate), 64.9 parts of MPTS (organopolysiloxane-1:3-methacryloxypropyl tris (trimethylsiloxy)silane), and 1 part of 1, 1'-azobis(cyclohexane-1-carbonitrile) (V-40 from Wako Pure Chemical Industries, Ltd.) are dissolved in 100 parts of MEK is dropped in the flask over a period of 2 hours at 80° C. under nitrogen gas flow. The mixture is subjected to aging for 5 hours. Thus, a resin 4 is prepared.

The resin 4 is diluted with MEK so that the diluted solution has 25% by weight of nonvolatile contents.

Preparation of Conductive Particles

Conductive Particle Manufacturing Example 1

A suspension is prepared by dispersing 100 g of aluminum oxide (AKP-30 from Sumitomo Chemical Co., Ltd.) in 1 liter of water, followed by heating at 70° C. A solution in which 100 g of tin(IV) chloride and 3 g of phosphorus pentoxide are dissolved in 1 liter of 2N hydrochloric acid and a 12% ammonia water are dropped in the suspension over a period of 2 hours so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 1 having a volume resistivity of 8 Ω·cm is prepared.

Conductive Particle Manufacturing Example 2

A suspension is prepared by dispersing 100 g of aluminum oxide (AKP-30 from Sumitomo Chemical Co., Ltd.) in 1 liter of water, followed by heating at 70° C. A solution in which 10 g of tin(IV) chloride and 0.30 g of phosphorus pentoxide are dissolved in 100 ml of 2N hydrochloric acid and a 12% ammonia water are dropped in the suspension over a period of 12 minutes so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 2 having a volume resistivity of 1,200 Ω·cm is prepared.

Conductive Particle Manufacturing Example 3

A suspension is prepared by dispersing 100 g of aluminum oxide (AKP-30 from Sumitomo Chemical Co., Ltd.) in 1 liter of water, followed by heating at 70° C. A solution in which 150 g of tin(IV) chloride and 4.5 g of phosphorus pentoxide are dissolved in 1.5 liters of 2N hydrochloric acid and a 12% ammonia water are dropped in the suspension over a period of 3 hours so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 3 having a volume resistivity of 3 Ω·cm is prepared.

Conductive Particle Manufacturing Example 4

A suspension is prepared by dispersing 100 g of aluminum oxide (AKP-30 from Sumitomo Chemical Co., Ltd.) in 1 liter of water, followed by heating at 70° C. A solution in which 6 g of tin(IV) chloride and 0.18 g of phosphorus pentoxide are dissolved in 60 ml of 2N hydrochloric acid and a 12% ammonia water are dropped in the suspension over a period of 8 minutes so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 4 having a volume resistivity of 7,000 Ω·cm is prepared.

Conductive Particle Manufacturing Example 5

A suspension is prepared by dispersing 100 g of aluminum oxide (AKP-30 from Sumitomo Chemical Co., Ltd.) in 1 liter of water, followed by heating at 70° C. A solution in which 170 g of tin(IV) chloride and 5.1 g of phosphorus pentoxide are dissolved in 1.7 liters of 2N hydrochloric acid and a 12% ammonia water are dropped in the suspension over a period of 3 hours and 20 minutes so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 5 having a volume resistivity of 2 Ω·cm is prepared.

Conductive Particle Manufacturing Example 6

A suspension is prepared by dispersing 100 g of aluminum oxide (AKP-30 from Sumitomo Chemical Co., Ltd.) in 1 liter of water, followed by heating at 70° C. A solution in which 55 g of zinc chloride and 0.2 g of a 25% aqueous solution of gallium chloride are dissolved in 500 ml of 2N hydrochloric acid and a 12% ammonia water are dropped in the suspension over a period of 1 hour so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 6 having a volume resistivity of 10 Ω·cm is prepared.

Conductive Particle Manufacturing Example 7

A suspension is prepared by dispersing 100 g of aluminum oxide (AKP-30 from Sumitomo Chemical Co., Ltd.) in 1 liter of water, followed by heating at 70° C. A solution in which 11.6 g of tin(IV) chloride are dissolved in 1 liter of 2N hydrochloric acid and a 12% ammonia water are dropped in the suspension over a period of 40 minutes so that pH of the suspension becomes 7 to 8. Further, a solution in which 36.7 g of indium chloride and 5.4 g of tin(IV) chloride are dissolved in 450 ml of 2N hydrochloric acid and a 12% ammonia water are dropped in the suspension over a period of 1 hour so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 7 having a volume resistivity of 4 Ω·cm is prepared.

Conductive Particle Manufacturing Example 8

A suspension is prepared by dispersing 100 g of a rutile-type titanium oxide (KR-310 from Titan Kogyo, Ltd.) in 1 liter of water, followed by heating at 70° C. A solution in which 100 g of tin(IV) chloride and 3 g of phosphorus pentoxide are dissolved in 1 liter of 2N hydrochloric acid and a 12% ammonia water are dropped in the suspension over a period of 2 hours so that pH of the suspension becomes 7 to 8. The suspension is then filtered and washed to obtain a cake. The cake is dried at 110° C. The resulting dried powder is treated at 500° C. for 1 hour under nitrogen gas flow. Thus, a conductive particle 8 having a volume resistivity of 12 Ω·cm is prepared.

Preparation of Carriers

Carrier Manufacturing Example 1

A resin solution is prepared by diluting 100 parts of the resin 1, 40 parts of the conductive particle 1, and 4 parts of a catalyst, i.e., titanium diisopropoxybis(ethylacetoacetate) (TC-750 from Matsumoto Fine Chemical Co., Ltd.) with toluene. The resin solution includes 10% by weight of solid components.

The resin solution is coated on a core particle, i.e., Mn ferrite particles having a weight average particle diameter of 35 μm using a fluidized-bed-type coating device at 70° C. so that the resulting resin layer has an average thickness of 0.30 μm. The core particles having the resin coating is further burnt in an electric furnace at 180° C. for 2 hours. Thus, a carrier A is prepared.

Carrier Manufacturing Example 2

The procedure for preparing the carrier A in Carrier Manufacturing Example 1 is repeated except for replacing the 40 parts of the conductive particle 1 with 80 parts of the conductive particle 2. Thus, a carrier B is prepared.

Carrier Manufacturing Example 3

The procedure for preparing the carrier A in Carrier Manufacturing Example 1 is repeated except for replacing the 40 parts of the conductive particle 1 with 60 parts of the conductive particle 3. Thus, a carrier C is prepared.

Carrier Manufacturing Example 4

The procedure for preparing the carrier A in Carrier Manufacturing Example 1 is repeated except for replacing the 40 parts of the conductive particle 1 with 100 parts of the conductive particle 4. Thus, a carrier D is prepared.

Carrier Manufacturing Example 5

The procedure for preparing the carrier A in Carrier Manufacturing Example 1 is repeated except for replacing the 40 parts of the conductive particle 1 with 10 parts of the conductive particle 5. Thus, a carrier E is prepared.

Carrier Manufacturing Example 6

The procedure for preparing the carrier A in Carrier Manufacturing Example 1 is repeated except for replacing the 40 parts of the conductive particle 1 with 50 parts of the conductive particle 6. Thus, a carrier F is prepared.

Carrier Manufacturing Example 7

The procedure for preparing the carrier A in Carrier Manufacturing Example 1 is repeated except for replacing the resin 1 with the resin 2. Thus, a carrier G is prepared.

Carrier Manufacturing Example 8

The procedure for preparing the carrier B in Carrier Manufacturing Example 2 is repeated except for replacing the resin 1 with the resin 2. Thus, a carrier H is prepared.

Carrier Manufacturing Example 9

The procedure for preparing the carrier C in Carrier Manufacturing Example 3 is repeated except for replacing the resin 1 with the resin 2. Thus, a carrier I is prepared.

Carrier Manufacturing Example 10

A resin solution is prepared by diluting 100 parts of the resin 1, 40 parts of the conductive particle 7, and 4 parts of a catalyst, i.e., titanium diisopropoxybis(ethylacetoacetate) (TC-750 from Matsumoto Fine Chemical Co., Ltd.) with toluene. The resin solution includes 10% by weight of solid components.

The resin solution is coated on a core particle, i.e., Mn ferrite particles having a weight average particle diameter of 35 μm using a fluidized-bed-type coating device at 70° C. so that the resulting resin layer has an average thickness of 0.30 μm. The core particles having the resin coating is further burnt in an electric furnace at 180° C. for 2 hours. Thus, a carrier J is prepared.

Carrier Manufacturing Example 11

The procedure for preparing the carrier J in Carrier Manufacturing Example 10 is repeated except that the amount of the conductive particle 7 is changed to 10 parts. Thus, a carrier K is prepared.

Carrier Manufacturing Example 12

The procedure for preparing the carrier J in Carrier Manufacturing Example 10 is repeated except that the amount of the conductive particle 7 is changed to 70 parts. Thus, a carrier L is prepared.

Carrier Manufacturing Example 13

The procedure for preparing the carrier A in Carrier Manufacturing Example 1 is repeated except that the resin 1 is replaced with the resin 3 and 30 parts of a methyl silicone resin (having 25% of solid components) having a weight average molecular weight of 15,000 obtained from difunctional and trifunctional monomers are further added. Thus, a carrier M is prepared.

Carrier Manufacturing Example 14

The procedure for preparing the carrier B in Carrier Manufacturing Example 2 is repeated except that the resin 1 is replaced with the resin 3 and 30 parts of a methyl silicone resin (having 25% of solid components) having a weight average molecular weight of 15,000 obtained from difunctional and trifunctional monomers are further added. Thus, a carrier N is prepared.

Carrier Manufacturing Example 15

The procedure for preparing the carrier C in Carrier Manufacturing Example 3 is repeated except that the resin 1 is replaced with the resin 3 and 30 parts of a methyl silicone resin (having 25% of solid components) having a weight average molecular weight of 15,000 obtained from difunctional and trifunctional monomers are further added. Thus, a carrier O is prepared.

Carrier Manufacturing Comparative Example 1

The procedure for preparing the carrier A in Carrier Manufacturing Example 1 is repeated except for replacing the conductive particle 1 with the conductive particle 8. Thus, a carrier P is prepared.

Carrier Manufacturing Comparative Example 2

The procedure for preparing the carrier A in Carrier Manufacturing Example 1 is repeated except for replacing the resin 1 with the resin 4. Thus, a carrier Q is prepared.

Evaluations of Carriers

The above-prepared carriers are subjected to the following evaluations.

i) Weight Average Particle Diameter of Core Particle

The weight average particle diameters of the core particles are measured by a Microtrac particle size analyzer (HRA9320-X100 from Honeywell International Inc.) under the following measurement conditions.

Particle diameter range: 100 to 8 μm
Channel width: 2 μm
Number of channels: 46
Refractive index: 2.42 ii) Magnetization in 1 kOe Magnetic Field

A measuring cell having an inner diameter of 2.4 mm and a height of 8.5 mm is filled with about 0.15 g of each of the carriers, and subjected to measurement of magnetization in a magnetic field of 1 kOe using an instrument VSM-P7-15 (from Toei Industry Co., Ltd.).

iii) Volume Resistivity

Figure 5:
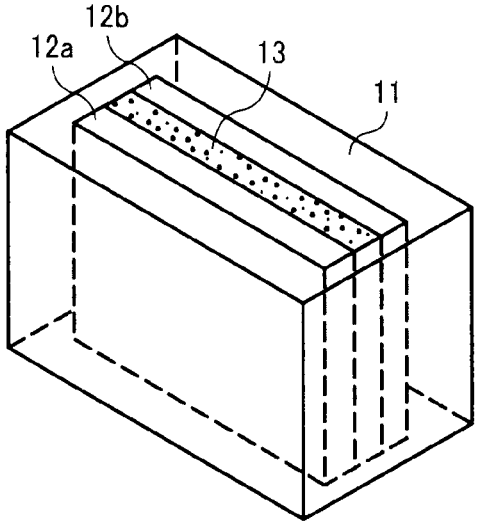
FIG. 5 illustrates a measuring cell used for measuring volume resistivity of carriers.

A measuring cell is illustrated in FIG. 5. The measuring cell comprised of a fluorocarbon-resin container 2, in which electrodes 1*a* and 1*b* each having a surface area of 2.5 cm×4 cm are facing at a distance of 0.2 cm, is filled with each of the carriers. The cell filled with the carrier is tapped from a height of 1 cm for 10 times at a tapping speed of 30 times/min. Thereafter, a direct current voltage of 1,000 V is applied to between the electrodes 1*a* and 1*b* for 30 seconds to measure a resistance r (Ω) by a high resistance meter 4329A (from Hewlett-Packard Japan. Ltd.). A volume resistivity (Ωcm) is calculated from the following equation:

$$r\times(2.5\times4)/0.2$$

iv) Average Thickness of Resin Layer

The average thicknesses of the resin layers are measured by observing cross-sections of the carriers using a transmission electron microscope (TEM).

The evaluation results are shown in Table 1.

TABLE 1

| Carrier | Resin | Conductive Particle | i) Weight Average Particle Diameter (μm) | ii) Magnetization (emu/g) | iii) Volume Resistivity LogR (Ω cm) | iv) Average Thickness of Resin Layer (μm) |
|---|---|---|---|---|---|---|
| A | 1 | 1 | 35.1 | 62 | 12.8 | 0.30 |
| B | 1 | 2 | 35.3 | 62 | 15.3 | 0.31 |
| C | 1 | 3 | 35.2 | 62 | 10.2 | 0.29 |
| D | 1 | 4 | 35.6 | 61 | 14.8 | 0.32 |
| E | 1 | 5 | 34.9 | 62 | 15.1 | 0.30 |
| F | 1 | 6 | 34.7 | 62 | 12.0 | 0.31 |
| G | 2 | 1 | 35.2 | 62 | 12.5 | 0.31 |
| H | 2 | 2 | 35.1 | 62 | 14.9 | 0.31 |
| I | 2 | 3 | 35.3 | 62 | 10.5 | 0.30 |
| J | 1 | 7 | 34.8 | 62 | 12.3 | 0.30 |
| K | 1 | 7 | 35.1 | 62 | 15.4 | 0.30 |
| L | 1 | 7 | 35.4 | 62 | 11.0 | 0.31 |
| M | 3 | 1 | 35.3 | 62 | 13.2 | 0.32 |
| N | 3 | 2 | 35.1 | 61 | 15.4 | 0.31 |
| O | 3 | 3 | 35.2 | 62 | 10.4 | 0.30 |
| P | 1 | 8 | 35.4 | 62 | 13.7 | 0.31 |
| Q | 4 | 1 | 35.2 | 62 | 13.4 | 0.31 |

Preparation of Toner

First, 100 parts of a polyester resin (having a weight average molecular weight (Mw) of 18,000, a number average molecular weight (Mn) of 4,000, a glass transition temperature (Tg) of 59° C., and a softening point of 120° C.), 5 parts of a carnauba wax, 10 parts of a carbon black (#44 from Mitsubishi Chemical Corporation), and 4 parts of a fluorine-containing quaternary ammonium salt are mixed by a HENSCHEL MIXER. The mixture is melt-kneaded by a double axis extruder. The kneaded mixture is extended by applying pressure, followed by cooling. The cooled extended mixture is coarsely pulverized by a cutter mill and then finely pulverized by a jet stream pulverizer. The pulverized particles are classified by size by a wind power classifier to collect mother toner particles having a weight average particle diameter of 7.4 μm.

The mother toner particles in an amount of 100 parts are mixed with 1.0 part of a hydrophobized silica (R972 from Nippon Aerosil Co., Ltd.) using a HENSCHEL MIXER. Thus, a toner 1 having a weight average particle diameter of 7.2 μm is prepared.

Preparation of Developer

Each of the carriers A to Q in an amount of 93 parts and the toner 1 in an amount of 7 parts are mixed for 20 minutes using a ball mill. Thus, developers A to Q are prepared.

Example 1

A digital image forming apparatus IMAGIO NEO C600 (from Ricoh Co., Ltd.) is modified such that the magnet fixed inside the developing sleeve is replaced with a rotatable cylindrical ferrite magnet having 12 magnetic poles, the surface of which has a magnetization of 800 Gauss, that rotates within the developing sleeve at 2,000 rpm or less. The developer A is set in this modified image forming apparatus and developing conditions are set as follows.

Developing gap (i.e., A distance between photoreceptor and developing sleeve): 0.3 mm Doctor gap (i.e., A distance between developing sleeve and doctor blade): 0.5 mm Linear speed of photoreceptor: 282 mm/sec (Linear speed of developing sleeve)/(Linear speed of photoreceptor): 1.1

Developing area width: 5 mm

Rotation number of magnet roller: 1,000 rpm/0 rpm

Rotation direction of magnet roller: Opposite to rotation direction of developing sleeve Writing density: 600 dpi Charged potential (Vd): −750 V Solid image potential after irradiation: −100V Developing bias: DC −550V After an initial image is printed, the developer is agitated for 10 minutes at monochrome mode. Thereafter, a running test in which an image chart having an image area of 7% is continuously formed on 100,000 sheets is performed. After the running test, the developer and the resulting image are subjected to evaluations to be described below.

Comparative Example 1

The procedure in Example 1 is repeated except that the developing conditions are changed as follows.

Developing gap (i.e., A distance between photoreceptor and developing sleeve): 0.3 mm Doctor gap (i.e., A distance between developing sleeve and doctor blade): 0.3 mm Linear speed of photoreceptor: 282 mm/sec (Linear speed of developing sleeve)/(Linear speed of photoreceptor): 2.0

Developing area width: 5 mm

Number of magnetic poles: 7

Normal magnetic force of the main pole: 1,200 Gauss (120 mT)

Rotation number of magnet roller: 0 rpm (i.e., fixed)

Writing density: 600 dpi

Charged potential (Vd): −750 V

Solid image potential after irradiation: −100V

Developing bias: DC −550V

Example 2

The procedure in Example 1 is repeated except for replacing the developer A with the developer B.

Example 3

The procedure in Example 1 is repeated except for replacing the developer A with the developer C.

Example 4

The procedure in Example 1 is repeated except for replacing the developer A with the developer D.

Example 5

The procedure in Example 1 is repeated except for replacing the developer A with the developer E.

Example 6

The procedure in Example 1 is repeated except for replacing the developer A with the developer F.

Example 7

The procedure in Example 1 is repeated except for replacing the developer A with the developer G.

Example 8

The procedure in Example 1 is repeated except for replacing the developer A with the developer H.

Example 9

The procedure in Example 1 is repeated except for replacing the developer A with the developer I.

Example 10

The procedure in Example 1 is repeated except for replacing the developer A with the developer J.

Example 11

The procedure in Example 1 is repeated except for replacing the developer A with the developer K.

Example 12

The procedure in Example 1 is repeated except for replacing the developer A with the developer L.

Example 13

The procedure in Example 1 is repeated except for replacing the developer A with the developer M.

Example 14

The procedure in Example 1 is repeated except for replacing the developer A with the developer N.

Example 15

The procedure in Example 1 is repeated except for replacing the developer A with the developer O.

Comparative Example 2

The procedure in Example 1 is repeated except for replacing the developer A with the developer P.

Comparative Example 3

The procedure in Example 1 is repeated except for replacing the developer A with the developer Q.

Evaluations of Developers

1) Variation in Developer Feed Rate

Variation in developer feed rate is calculated from the following equation and graded into four levels.

Variation (%) in developer feed rate={(Developer feed rate ($mg/cm^2$) in the initial stage−Developer feed rate ($mg/cm^2$) after the running test)/Developer feed rate ($mg/cm^2$) in the initial stage}×100

A (Very good): Less than ±5%

B (Good): Not less than ±5% and less than ±10%

C (Usable): Not less than ±10% and less than ±20%

D (Not usable): Not less than ±20%

2) Amount of Toner Components Adhered to Carrier

Toner components adhered to the carrier are extracted with methyl ethyl ketone before and after the running test. The difference between the weight of the extracted toner components before the running test and that after the running test is graded into the following four levels.

A (Very good): Not less than 0 and less than 0.03% by weight based on carrier

B (Good): Not less than 0.03% and less than 0.07% by weight based on carrier

C (Usable): Not less than 0.07% and less than 0.15% by weight based on carrier

D (Not usable): Not less than 0.15% by weight based on carrier

3) Environmental Variation in Toner Charge Per Mass

Environmental variation in toner charge per mass (hereinafter "Q/M") is calculated from the following equation and graded into four levels.

Environmental variation (%) in $Q/M$=2×{($Q/M$ at 10° C., 15% RH−$Q/M$ at 30° C., 90% RH)/($Q/M$ at 10° C., 15% RH+$Q/M$ at 30° C., 90% RH)}×100

A (Very good): Not less than 0 and less than 10%

B (Good): Not less than 10% and less than 30%

C (Usable): Not less than 30% and less than 70%

D (Not usable): Not less than 70%

Figure 6:
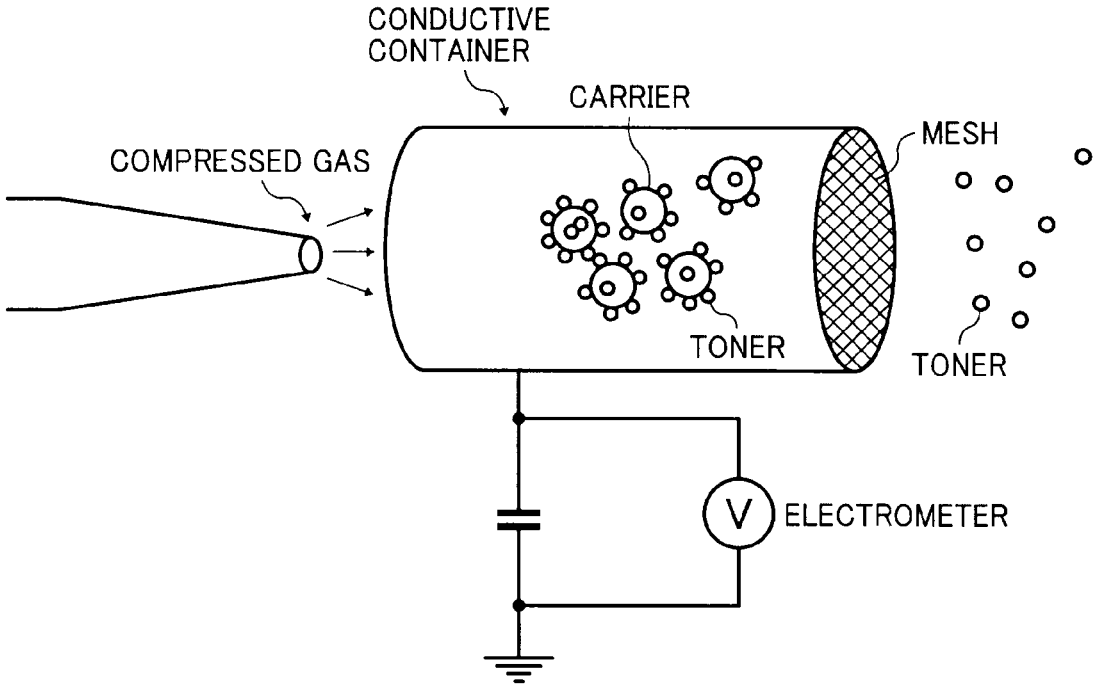
FIG. 6 illustrates a device for measuring toner charge per mass (Q/M)

Toner charge per mass (Q/M) is measured using a device illustrated in FIG. 6. A predetermined amount of the developer is contained in a conductive container equipped with stainless-steel meshes having openings of 20 μm on both ends. The size of the openings is selected so that the particle diameter of the toner is smaller than the openings and that of the carrier is larger than the openings. Compressed nitrogen gas (1 $kg/cm^2$) is blown from a nozzle to the mesh for 60 seconds so that only toner particles fly out of the container. Carrier particles remaining in the container have the same absolute charge quantity as the toner particles and the opposite polarity to the toner particles. Thus, charge quantity Q (μC) of the remaining carrier particles and the weight M (g) of the toner particles are weighed to determine Q/M (μC/g).

The evaluation results of the developers are shown in Table 2.

TABLE 2

| | | | Properties of Developer After Running Test | | | | | |
|---|---|---|---|---|---|---|---|---|
| | Developer | Rotation Number of Magnet (rpm) | Q/M (μC/g) | Volume Resistivity LogR (Ωcm) | Average Thickness of Resin Layer (μm) | 2) Amount of Toner Components Adhered to Carrier | 3) Environmental Variation in Q/M | 1) Variation in Developer Feed Rate |
| Example 1 | A | 1,000 | 31 | 12.0 | 0.22 | A | B | C |
| Comparative Example 1 | A | 0 (fixed) | 34 | 12.5 | 0.28 | A | B | A |
| Example 2 | B | 1,000 | 35 | 14.4 | 0.27 | B | B | A |
| Example 3 | C | 1,000 | 30 | 9.6 | 0.24 | B | B | B |
| Example 4 | D | 1,000 | 34 | 14.5 | 0.29 | B | B | A |
| Example 5 | E | 1,000 | 30 | 13.2 | 0.21 | A | B | C |
| Example 6 | F | 1,000 | 32 | 10.6 | 0.26 | B | B | B |
| Example 7 | G | 1,000 | 30 | 12.2 | 0.26 | B | A | B |
| Example 8 | H | 1,000 | 34 | 14.6 | 0.29 | B | A | A |
| Example 9 | I | 1,000 | 33 | 10.3 | 0.27 | B | A | A |
| Example 10 | J | 1,000 | 32 | 12.1 | 0.25 | B | A | B |
| Example 11 | K | 1,000 | 31 | 13.6 | 0.22 | A | B | C |
| Example 12 | L | 1,000 | 30 | 10.6 | 0.28 | B | A | A |
| Example 13 | M | 1,000 | 32 | 11.8 | 0.24 | A | A | B |
| Example 14 | N | 1,000 | 33 | 13.9 | 0.26 | B | B | B |
| Example 15 | O | 1,000 | 34 | 10.2 | 0.28 | B | B | A |
| Comparative Example 1 | P | 1,000 | 18 | 10.3 | 0.19 | C | D | C |
| Comparative Example 2 | Q | 1,000 | 14 | 9.0 | 0.16 | D | C | D |

Evaluations of Image Qualities

4) Solid Image Density

Randomly selected 5 portions in the resulting solid image having an area of 30 mm×30 mm formed on paper are subjected to measurement of image density using a spectrodensitometer X-RITE 938, and the measured values are averaged. The solid image is formed on a portion where the developing potential is 400 V=(Irradiated portion potential−Developing bias DC)=−100 V−(−500 V).

5) Granularity

Granularity (brightness range: 50-80) of the resulting image formed on paper is determined from the following equation and graded into four levels.

$$\text{Granularity}=\exp(aL+b)\int(WS(f))^{1/2}\cdot VTF(f)df$$

wherein L represents an average brightness, f represents a spatial frequency (cycle/mm), WS(f) represents a power spectrum of brightness variation, VTF(f) represents a spatial frequency characteristic of vision, and each of a and b represents a coefficient.

A (Very good): Not less than 0 and less than 0.2

B (Good): Not less than 0.2 and less than 0.3

C (Usable): Not less than 0.3 and less than 0.4

D (Not usable): Not less than 0.4

6) Background Fouling

The resulting image formed on paper is visually observed to determine whether background portion has fouling or not. The conditions are graded into the following four levels.

A (Very good)

B (Good)

C (Usable)

D (Not usable)

7) Carrier Deposition (in Solid Image Portion)

Carrier particles undesirably deposited on image may make scratches on photoreceptor and fixing roller and degrade the resulting image quality. Even when carrier particles are deposited on photoreceptor, only a part of the carrier particles are to be transferred onto paper. Thus, the degree of carrier deposition is evaluated as follows.

The solid image (30 mm×30 mm) formed on the photoreceptor under the above-described developing condition in which the charged potential (Vd) is −600 V, the irradiated portion (solid image portion) potential is −100V, and the developing bias DC is −500 V, is transferred onto an adhesive tape. The number of carrier particles adhered to the tape is visually counted to determine the degree of carrier deposition.

A (Very good)

B (Good)

C (Usable)

D (Not usable)

8) Carrier Deposition (in Edge Portion)

Figure 7:
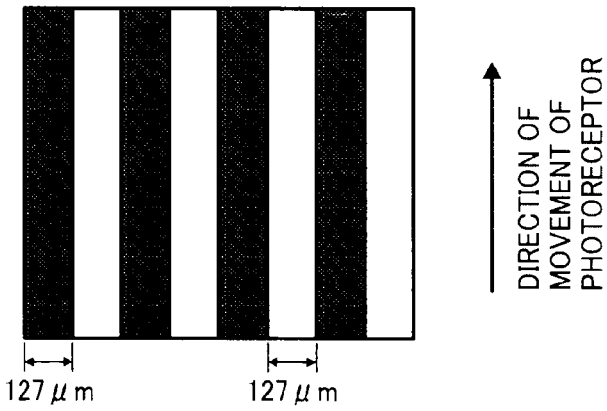
FIG. 7 illustrates a 2-dot-line image used for evaluation of image quality.

A 2-dot-line image (100 lpi) illustrated in FIG. 7 is formed on the photoreceptor in the vertical scanning direction under a developing condition in which the charged potential (Vd) is −600 V, the irradiated portion potential is −100V, the developing bias (Vb) DC is −400 V, and the background potential is −200 V.

The 2-dot-line image is transferred onto an adhesive tape (having an area of 100 $cm^2$). The number of carrier particles adhered to the tape is visually counted to determine the degree of carrier deposition.

A (Very good)

B (Good)

C (Usable)

D (Not usable)

9) White Blanks in Trailing Edge (in Solid Portion)

The trailing edge of the above-described solid image having an area of 30 mm×30 mm (having a latent image potential of −150 V) is visually observed with a loupe with a magnification of 10 times to measure the width of white blanks. The conditions are graded into the following four levels.

A (Very good): Less than 0.1 mm

B (Good): Not less than 0.1 mm and less than 0.3 mm

C (Usable): Not less than 0.3 mm and less than 0.8 mm

D (Not usable): Not less than 0.8 mm

10) White Blanks in Trailing Edge (in Halftone Portion)

A chart including multiple images (10 mm×10 mm) each having an image density of 0.2 to 1.2 at an interval of 0.1 is copied under the above-described developing condition. The copy is visually observed with a loupe with a magnification of 10 times to determine the maximum image density above which white blanks appears. As the maximum image density becomes lower, it means that white blanks are more unlikely to appear in the trailing edge. The conditions are graded into the following four levels.

A (Very good): Less than 0.2

B (Good): Not less than 0.2 and less than 0.3

C (Usable): Not less than 0.3 and less than 0.5

D (Not usable): Not less than 0.5

11) Line Aspect Ratio

An image including a vertical line (i.e., coincident with the sheet feed direction) and a lateral line (i.e., perpendicular to the sheet feed direction) each having a width of 50 μm is copied. The widths of the vertical and lateral lines in the copy are measured to determine the line aspect ratio, i.e., the ratio of the vertical line width to the lateral line width. The best aspect ratio is 1.0. The greater the aspect ratio, the worse the image quality.

A (Very good): Less than 1.1

B (Good): Not less than 1.1 and less than 1.2

C (Usable): Not less than 1.2 and less than 1.4

D (Not usable): Not less than 1.4

12) Environmental Variation in Image Density

Environmental variation in image density is determined from the difference between the image density at 30° C., 90% RH and that at 10° C., 15% RH and graded into the following four levels.

A (Very good): Not less than 0 and less than 0.05

B (Good): Not less than 0.05 and less than 0.15

C (Usable): Not less than 0.15 and less than 0.25

D (Not usable): Not less than 0.25

13) Toner Scattering

Periphery of the developing device is visually observed after the running test to determine the degree of toner scattering. The conditions are graded into the following four levels.

A (Very good)

B (Good)

C (Usable)

D (Not usable)

The evaluation results are shown in Tables 3-1, 3-2, 4-1 and 4-2.

TABLE 3-1

| | | Initial Image Qualities | | | | |
|---|---|---|---|---|---|---|
| | Developer | 4) Solid Image Density | 5) Granularity | 6) Background Fouling | 7) Carrier Deposition (in Solid Image Portion) | 8) Carrier Deposition (in Edge Portion) |
| Example 1 | A | 1.53 | A | A | A | A |
| Comparative Example 1 | A | 1.49 | B | B | A | A |
| Example 2 | B | 1.45 | A | A | A | B |
| Example 3 | C | 1.56 | A | B | B | A |
| Example 4 | D | 1.47 | A | A | A | B |
| Example 5 | E | 1.54 | A | B | A | B |
| Example 6 | F | 1.52 | A | A | A | A |
| Example 7 | G | 1.55 | A | A | A | A |
| Example 8 | H | 1.46 | A | A | A | B |
| Example 9 | I | 1.49 | A | B | B | A |
| Example 10 | J | 1.52 | A | A | A | A |
| Example 11 | K | 1.53 | A | B | A | B |
| Example 12 | L | 1.55 | A | A | B | A |

TABLE 3-1-continued

| | | Initial Image Qualities | | | | |
|---|---|---|---|---|---|---|
| | Developer | 4) Solid Image Density | 5) Granularity | 6) Background Fouling | 7) Carrier Deposition (in Solid Image Portion) | 8) Carrier Deposition (in Edge Portion) |
| Example 13 | M | 1.51 | A | A | A | A |
| Example 14 | N | 1.49 | A | B | A | B |
| Example 15 | O | 1.48 | A | B | B | A |
| Comparative Example 1 | P | 1.47 | A | A | A | A |
| Comparative Example 2 | Q | 1.51 | A | A | A | A |

TABLE 3-2

| | | Initial Image Qualities | | |
|---|---|---|---|---|
| | Developer | 9) White Blanks in Trailing Edge (in Solid Portion) | 10) White Blanks in Trailing Edge (in Halftone Portion) | 11) Line Aspect Ratio |
| Example 1 | A | A | A | A |
| Comparative Example 1 | A | C | D | C |
| Example 2 | B | B | B | B |
| Example 3 | C | A | A | B |
| Example 4 | D | B | B | B |
| Example 5 | E | B | B | B |
| Example 6 | F | A | A | A |
| Example 7 | G | A | A | A |
| Example 8 | H | B | B | B |
| Example 9 | I | A | B | A |
| Example 10 | J | A | A | A |
| Example 11 | K | B | B | B |
| Example 12 | L | A | A | A |
| Example 13 | M | A | A | A |
| Example 14 | N | B | B | B |
| Example 15 | O | A | B | B |
| Comparative Example 1 | P | A | A | A |
| Comparative Example 2 | Q | A | A | A |

TABLE 4-1

| | | Image Qualities After Running Test | | | | |
|---|---|---|---|---|---|---|
| | Developer | 4) Solid Image Density | 5) Granularity | 6) Background Fouling | 7) Carrier Deposition (in Solid Image Portion) | 8) Carrier Deposition (in Edge Portion) |
| Example 1 | A | 1.58 | B | A | A | B |
| Comparative Example 1 | A | 1.53 | B | B | B | A |
| Example 2 | B | 1.50 | A | A | A | A |
| Example 3 | C | 1.65 | B | C | C | A |
| Example 4 | D | 1.52 | A | B | A | A |
| Example 5 | E | 1.60 | B | B | B | B |
| Example 6 | F | 1.59 | B | A | B | A |
| Example 7 | G | 1.60 | A | A | A | A |
| Example 8 | H | 1.52 | A | A | A | A |
| Example 9 | I | 1.60 | B | B | B | A |
| Example 10 | J | 1.56 | A | A | A | A |
| Example 11 | K | 1.59 | B | B | B | A |
| Example 12 | L | 1.61 | B | B | B | A |
| Example 13 | M | 1.58 | B | B | B | A |
| Example 14 | N | 1.55 | A | B | A | A |
| Example 15 | O | 1.58 | B | B | B | A |

TABLE 4-1-continued

| | Developer | Image Qualities After Running Test | | | | |
|---|---|---|---|---|---|---|
| | | 4) Solid Image Density | 5) Granularity | 6) Background Fouling | 7) Carrier Deposition (in Solid Image Portion) | 8) Carrier Deposition (in Edge Portion) |
| Comparative Example 1 | P | 1.67 | C | D | D | B |
| Comparative Example 2 | Q | 1.47 | D | D | D | B |

TABLE 4-2

| | Developer | Image Qualities After Running Test | | | | |
|---|---|---|---|---|---|---|
| | | 9) White Blanks in Trailing Edge (in Solid Portion) | 10) White Blanks in Trailing Edge (in Halftone Portion) | 11) Line Aspect Ratio | 12) Environmental Variation in Image Density | 13) Toner Scattering |
| Example 1 | A | A | A | A | B | B |
| Comparative Example 1 | A | D | D | D | B | B |
| Example 2 | B | A | A | A | B | A |
| Example 3 | C | A | B | D | B | C |
| Example 4 | D | A | A | A | B | A |
| Example 5 | E | A | A | A | B | B |
| Example 6 | F | A | B | B | B | B |
| Example 7 | G | A | A | A | B | B |
| Example 8 | H | B | B | B | B | A |
| Example 9 | I | A | B | A | B | B |
| Example 10 | J | A | A | A | B | A |
| Example 11 | K | A | A | A | B | A |
| Example 12 | L | A | A | A | B | C |
| Example 13 | M | A | A | A | B | B |
| Example 14 | N | A | A | A | B | B |
| Example 15 | O | A | B | B | B | C |
| Comparative Example 1 | P | C | D | D | D | D |
| Comparative Example 2 | Q | D | D | D | C | D |

Additional modifications and variations of the present invention are possible in light of the above teachings. It is therefore to be understood that within the scope of the appended claims the invention may be practiced other than as specifically described herein.

What is claimed is:

1. A contact developing method, comprising:

supplying a two-component developer to an electrostatic latent image on a rotating image bearing member by rotating a developing sleeve and a rotatable magnet having multiple magnetic poles provided inside the developing sleeve, to develop the electrostatic latent image into a toner image, the developing sleeve and the image bearing member rotating in a same direction while facing each other, the two-component developer comprising a non-magnetic toner and a carrier, the carrier comprising a magnetic core particle and a resin layer covering the magnetic core particle, the resin layer comprising a conductive particle and a resin, the conductive particle comprising an alumina-based material and a conductive layer covering the alumina-based material, and the resin being obtained by heating a copolymer comprising a monomer A unit having the following formula (1) and a monomer B unit having the following formula (2):

(1)

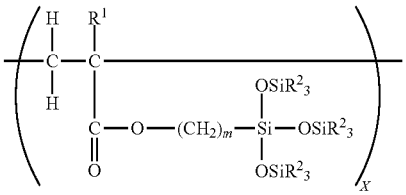

Monomer A unit (2)

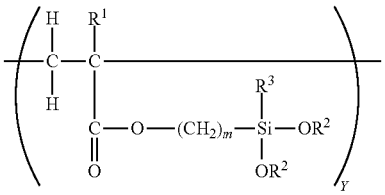

Monomer B unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, and each of X and Y represents a molar ratio (%) between 10 to 90.

2. The contact developing method according to claim 1, wherein the conductive layer comprises a tin dioxide.

3. The contact developing method according to claim 2, wherein the conductive layer comprises the tin dioxide in an amount of 4 to 80% by weight.

4. The contact developing method according to claim 1, wherein the conductive layer comprises a tin dioxide and an indium oxide.

5. The contact developing method according to claim 1, wherein the copolymer comprises a copolymer having the following formula (5):

(5)

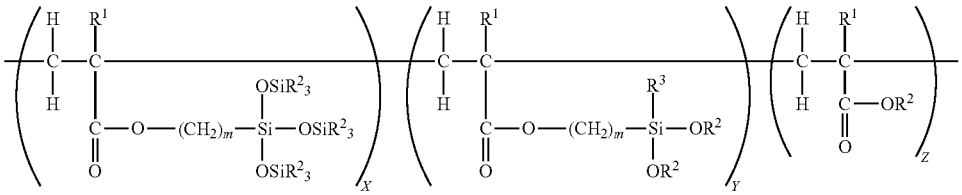

Monomer A unit Monomer B unit Monomer C unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, each of X and Y represents a molar ratio (%) between 10 to 40, Z represents a molar ratio (%) between 30 to 80, and $60<Y+Z<90$ is satisfied.

6. The contact developing method according to claim 1, wherein the copolymer is heated at 100 to 350° C.

7. The contact developing method according to claim 1, wherein the carrier has a volume resistivity of $1\times10^{10}$ to $1\times10^{17}$ Ω·cm.

8. The contact developing method according to claim 1, wherein the resin layer has an average thickness of 0.05 to 4 μm.

9. The contact developing method according to claim 1, wherein the core particle has a weight average particle diameter of 20 to 65 μm.

10. The contact developing method according to claim 1, wherein the carrier has a magnetization of 40 to 90 $Am^2/kg$ in a magnetic field of 1 kOe.

* * * * *